US006536220B2

(12) United States Patent
Visaisouk

(10) Patent No.: US 6,536,220 B2
(45) Date of Patent: Mar. 25, 2003

(54) METHOD AND APPARATUS FOR PRESSURE-DRIVEN ICE BLASTING

(75) Inventor: Sam Visaisouk, Mercer Island, WA (US)

(73) Assignee: Universal Ice Blast, Inc., Kirkland, WA (US)

( * ) Notice: Subject to any disclaimer, the term of this patent is extended or adjusted under 35 U.S.C. 154(b) by 0 days.

(21) Appl. No.: 09/854,254

(22) Filed: May 11, 2001

(65) Prior Publication Data

US 2002/0166328 A1 Nov. 14, 2002

(51) Int. Cl.[7] ..... F25C 5/02
(52) U.S. Cl. ..... 62/71; 62/354
(58) Field of Search ..... 62/354, 71; 451/75, 451/39

(56) References Cited

U.S. PATENT DOCUMENTS

| | | | | |
|---|---|---|---|---|
| 2,549,215 A | | 4/1951 | Mansted | |
| 3,494,144 A | | 2/1970 | Schill | |
| 4,497,184 A | | 2/1985 | Utter et al. | |
| 4,512,160 A | | 4/1985 | Mas | |
| 4,538,428 A | | 9/1985 | Wilkerson | |
| 4,655,847 A | * | 4/1987 | Ichinoseki et al. | 134/7 |
| 4,703,590 A | | 11/1987 | Westergaard | |
| 4,932,223 A | | 6/1990 | Paul et al. | |
| 4,965,968 A | | 10/1990 | Kelsall | |
| 4,977,910 A | * | 12/1990 | Miyahara et al. | 134/7 |
| 5,203,794 A | * | 4/1993 | Stratford et al. | 451/39 |
| 5,249,426 A | | 10/1993 | Spivak et al. | |
| 5,365,699 A | * | 11/1994 | Armstrong et al. | 451/40 |
| 5,367,838 A | | 11/1994 | Visaisouk | |
| 5,483,563 A | | 1/1996 | Herb | |
| 5,520,572 A | | 5/1996 | Opel et al. | |

FOREIGN PATENT DOCUMENTS

| | | |
|---|---|---|
| CA | 1324591 | 11/1993 |
| FR | 2475425 | 2/1980 |
| FR | 2494160 | 11/1980 |
| WO | WO 97/46838 | 12/1997 |

OTHER PUBLICATIONS

Herb and Visaisouk, *Ice Blasting for Precision Cleaning,* Precision Cleaning 1996 Proceedings, p. 172 (1996).

Visaisouk and Fisher, *Deburring and Cleaning by Ice Blast—A Case Study,* 5th International Deburring and Surface Finishing Conference Proceedings, San Francisco, California (1998).

*Modular Flaker,* Scotsman Model MFE400, Scotsman Ice Systems, 775 Corporate Woods Parkway, Vernon Hills, Illinois 60061.

*Primary Examiner*—William E. Tapolcai
*Assistant Examiner*—Mohammad M. Ali
(74) *Attorney, Agent, or Firm*—Christensen O'Connor Johnson Kindness PLLC

(57) ABSTRACT

A method and apparatus for substantially continuously producing a stream of ice particulates P for use in performing ice blasting work on a work object W. The present invention includes an extruder assembly, a blast nozzle, and an ice-receiving line. The extruder assembly includes a pressure vessel within which the ice particulates are formed under elevated pressure. The extruder assembly further includes an ice discharge opening. The ice-receiving line has a first end adapted to receive a fluidizing gas from the pressurized air supply source and a second end connected to the blast nozzle. The ice-receiving line is in communication with the extruder assembly ice discharge opening. The pressurized ice particulates P are passed from the pressure vessel discharge opening to the pressurized ice-receiving line. The fluidized ice particulates move via pressure flow towards a blast nozzle to be expelled from the nozzle towards a work object.

(List continued on next page.)

21 Claims, 7 Drawing Sheets

U.S. PATENT DOCUMENTS

| | | | | | |
|---|---|---|---|---|---|
| 5,601,478 | A | | 2/1997 | Mesher | |
| 5,623,831 | A | | 4/1997 | Mesher | |
| 5,779,523 | A | | 7/1998 | Mesher | |
| 5,785,581 | A | | 7/1998 | Settles | |
| 5,820,447 | A | | 10/1998 | Niechcial | |
| 5,910,042 | A | * | 6/1999 | Niechcial | 451/39 |
| 6,174,225 | B1 | * | 1/2001 | Becker | 451/39 |
| 6,270,394 | B1 | | 8/2001 | Visaisouk et al. | |

* cited by examiner

METHOD AND APPARATUS FOR PRESSURE-DRIVEN ICE BLASTING

FIELD OF THE INVENTION

The present invention relates to a method and devices for cleaning, decontaminating, deburring, or smoothing a work surface. More particularly, the present invention relates to a method whereby ice particulates are formed under pressure and transported by pressure flow to a nozzle which propels the same at high speeds for delivery to the work surface for cleaning, decontaminating, deburring, paint stripping, or smoothing.

BACKGROUND OF THE INVENTION

In recent years there has been increasing interest in the use of ice blasting techniques to treat surfaces. For certain applications, ice blasting provides significant advantages over other abrasion techniques, such as chemical surface treatment, blasting with abrasive materials, hydro-blasting, or blasting with steam or dry ice. Ice blasting can be used to remove loose material, blips and burrs from production metal components and even softer materials. Because water in either frozen or liquid form is environmentally safe, ice blasting does not pose a waste disposal problem. Also, ice blasting is relatively inexpensive, as compared to other methods for cleaning and treating a surface.

Because of these apparent advantages, ice blasting has generated significant commercial interest which has led to the development of a variety of devices designed to deliver a spray containing ice particulates for performing surface treatment procedures. Typically, these ice blasting devices form ice particulates that are then collected and transported via suction to a blast nozzle for discharge onto a work surface. Since ice particulates are not abrasive in and of themselves, most applications require that the ice particulates be expelled from the nozzle at a very high velocity in order to perform useful work. In general, high particulate velocities are derived from high blast air pressures in the range of about 150 psi to about 200 psi. At these pressures, the blasting devices can quickly suction and propel ice particulates through the blast nozzle with sufficient momentum to do useful work on the work surface.

These prior art suction-driven devices have been used successfully in construction environments, where large air compressors are available, and in manufacturing environments, where dedicated air compressors have been installed. In these cases, sufficient air pressure is available to suction and expel the ice particulates. However, a number of manufacturing environments have air pressure supplies that deliver air pressure in significantly lower amounts, e.g., in the range of about 70 psi to about 100 psi. In these environments, the ice blasting devices that rely on high pressure air to suction ice particulates into the delivery nozzle and onto a work surface do not perform effectively.

Some of the currently known ice blasting devices are pressurized. For example, U.S. Pat. No. 6,001,000 discloses an ice particulate forming device enclosed in a pressure vessel. This and other prior art suction devices are too large and too mechanically complex to be enclosed in a pressure vessel for practical use. Another pressurized ice blasting device currently known (U.S. Pat. No. 5,785,581) produces extremely fine ice particulates formed from the mixing of a cryogenic fluid with atomized water in a nozzle assembly. The use of cryogenic fluids and the small size of such resulting ice particulates are not suitable for many industrial applications. Further, current ice blasting devices are not easily adapted to production operations in which the quantity of ice blasting work varies.

Thus, a need exists for an ice blasting method and apparatus that can provide the economic and environmental advantages that ice blasting permits, and that is capable of being used in manufacturing environments that do not have a high air pressure supply source. Such an apparatus should also be easily modified to accommodate varying levels of ice blasting requirements. The present invention is directed to fulfilling these needs and others as described below.

SUMMARY OF THE INVENTION

The invention provides a method and apparatus for producing a stream of ice particulates for use in ice blasting work. The method includes substantially continuously producing ice particulates in an extruder assembly. The extruder assembly includes a pressure vessel within which the ice particulates are formed under elevated pressure. The ice particulates are passed from the pressure vessel to an ice-receiving line containing a fluidizing gas medium from a high pressure supply. The fluidized ice particulates are then discharged from the ice-receiving line through a blast nozzle at atmospheric pressure toward the work surface. A pressure gradient thus exists between the inlet and the discharge of the ice-receiving line, providing a pressure driven flow of particulates through the line and out the nozzle. In one embodiment, the extruder pressure vessel maintains an elevated pressure by receiving pressurized water.

Accordingly, an apparatus for supplying and accelerating ice particulates includes one or more extruder assemblies each having a water input port adapted to receive pressurized water from a supply source and each having an ice discharge opening. The ice-receiving line includes a first end adapted to continuously receive the pressurized fluidizing gas medium from a pressurized air supply source and a second end connected to the blast nozzle. The ice-receiving line is also connected to the extruder assembly ice discharge opening. In one embodiment, the connection is accomplished using an intermediate connection member.

Various alternative embodiments of the present invention apparatus are provided. In one embodiment, at least one extruder assembly is located on top of a movable refrigeration unit. This arrangement allows the apparatus to be easily moved from one location to another without affecting the device or causing work stops. In another embodiment, the apparatus is adapted to a production-line environment in which work objects are moved along a conveyor belt. An upright support frame is located near the conveyor belt and includes an upper shelf. One or more extruder assemblies are located on the upper shelf. An ice-receiving line receives ice particulates from the extruder assemblies and sends the particulates to a blast nozzle that is positioned directly above the conveyor belt. As objects move under the nozzle, useful work is performed as the ice particulates impinge upon the object.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention provides a method and an apparatus to produce a continuous stream of ice particulates, transport the ice particulates by pressure flow to a blast nozzle, and discharge the ice particles from the blast nozzle at high velocity. The driven ice particulates impact a work surface, W, with sufficient momentum to perform impact work. (As used herein, the term "impact work" refers generically to all types of use of which ice blasting is made, including but not limited to cleaning, paint or other coating removal, decontaminating, smoothing, and deburring.)

In general, the ice blasting apparatus of the present invention uses an extruder assembly to produce a continuous supply of ice particulates at high pressure. The extruder assembly supplies the ice particulates to an ice-receiving line. The ice-receiving line is connected at one end to a source of pressurized air (or other gas such as nitrogen) and is connected at the other end to a blast nozzle. In this regard, the elevated pressure within the extruder assembly is the same as the elevated pressure inside the ice-receiving line. Ice particulates are mechanically discharged into the ice-receiving line from the extruder. This eliminates any need to rely on the air supply source to suction the ice particulates into the ice-receiving line. In operation, the pressure gradient is established within the ice-receiving line between the high pressure of the air supply and the atmospheric pressure of the discharge nozzle, which keeps the fluidized ice particulates moving toward the nozzle. A pressure drop thus occurs as the particulates exit the blast nozzle to the surrounding ambient atmosphere. In preferred embodiments, the present invention provides for regulation of the quantity of ice produced so that larger or smaller amounts may be made available as blasting requirements change.

The apparatus of the invention may be better understood with reference to the accompanying figures that schematically represent preferred embodiments of the apparatus for making ice particulates and delivering them through a blast nozzle onto the surface of a substrate. Clearly, other embodiments are also within the scope of the invention, but reference to the preferred embodiments of the figures facilitates an explanation of aspects of the invention.

Figure 1:
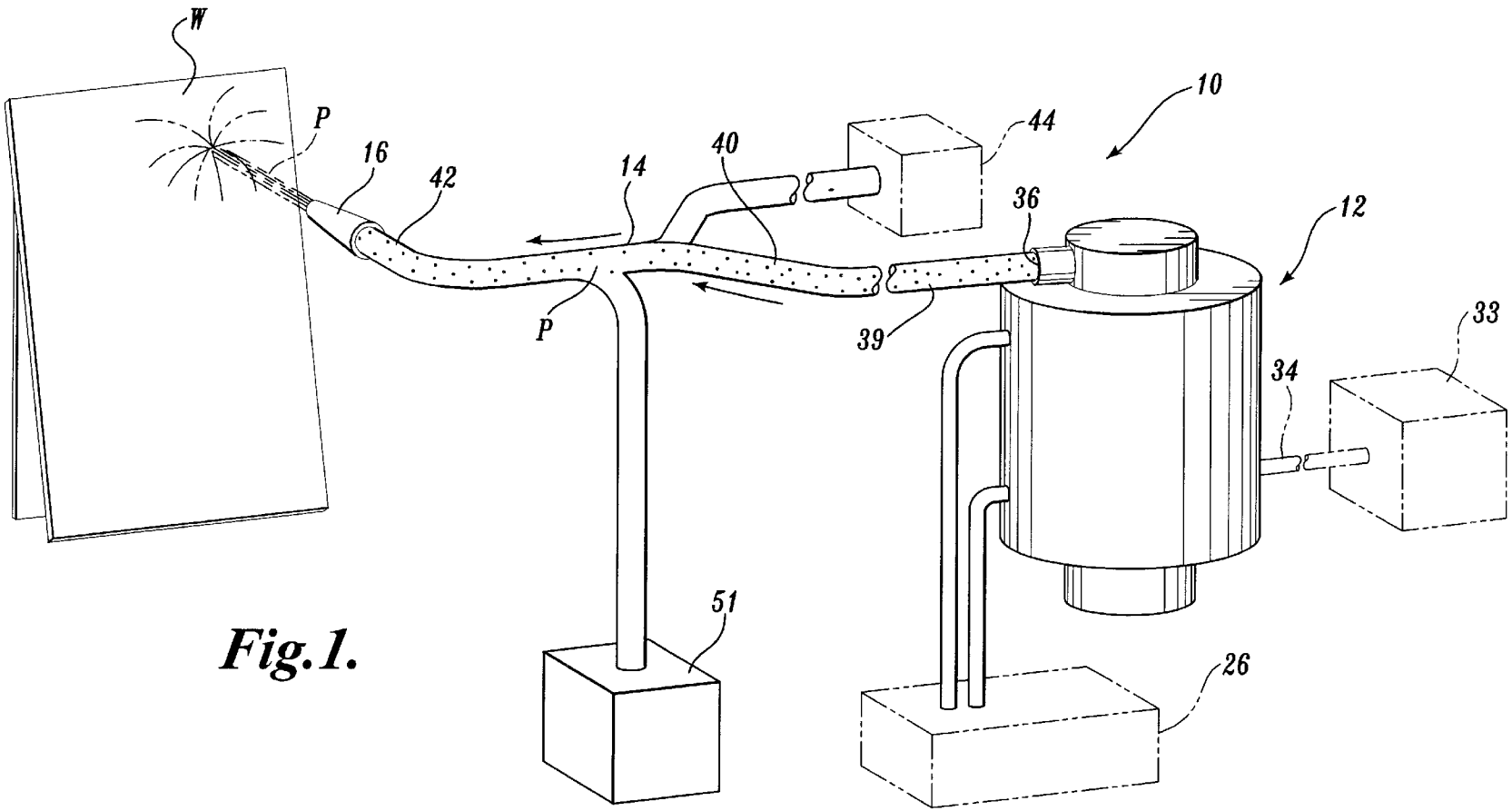
FIG. 1 is a schematic perspective view of an embodiment of an ice blasting apparatus formed in accordance with the present invention.

Referring to FIG. 1, the present invention ice blasting apparatus 10 includes an extruder assembly 12, an ice-receiving line 14, and a conventional blast nozzle 16. The extruder assembly 12 may be a conventional component, e.g., the flaker mechanism of the Scotsman Model MRF400, or the ice-making apparatus of U.S. Pat. No. 4,932,223 incorporated herein by reference. Alternatively, the extruder assembly may be a new extruder assembly design, such as the auger arrangements shown in FIGS. 2 and 4 herein. In general, the extruder assembly 12 includes an enclosure capable of being internally pressurized, preferably at 30 psi to about 120 psi, but suitably up to about 250 psi, and should be capable of continuously producing ice particulates. Within these requirements, various types of extruder assemblies are possible and may be used.

Figure 2:
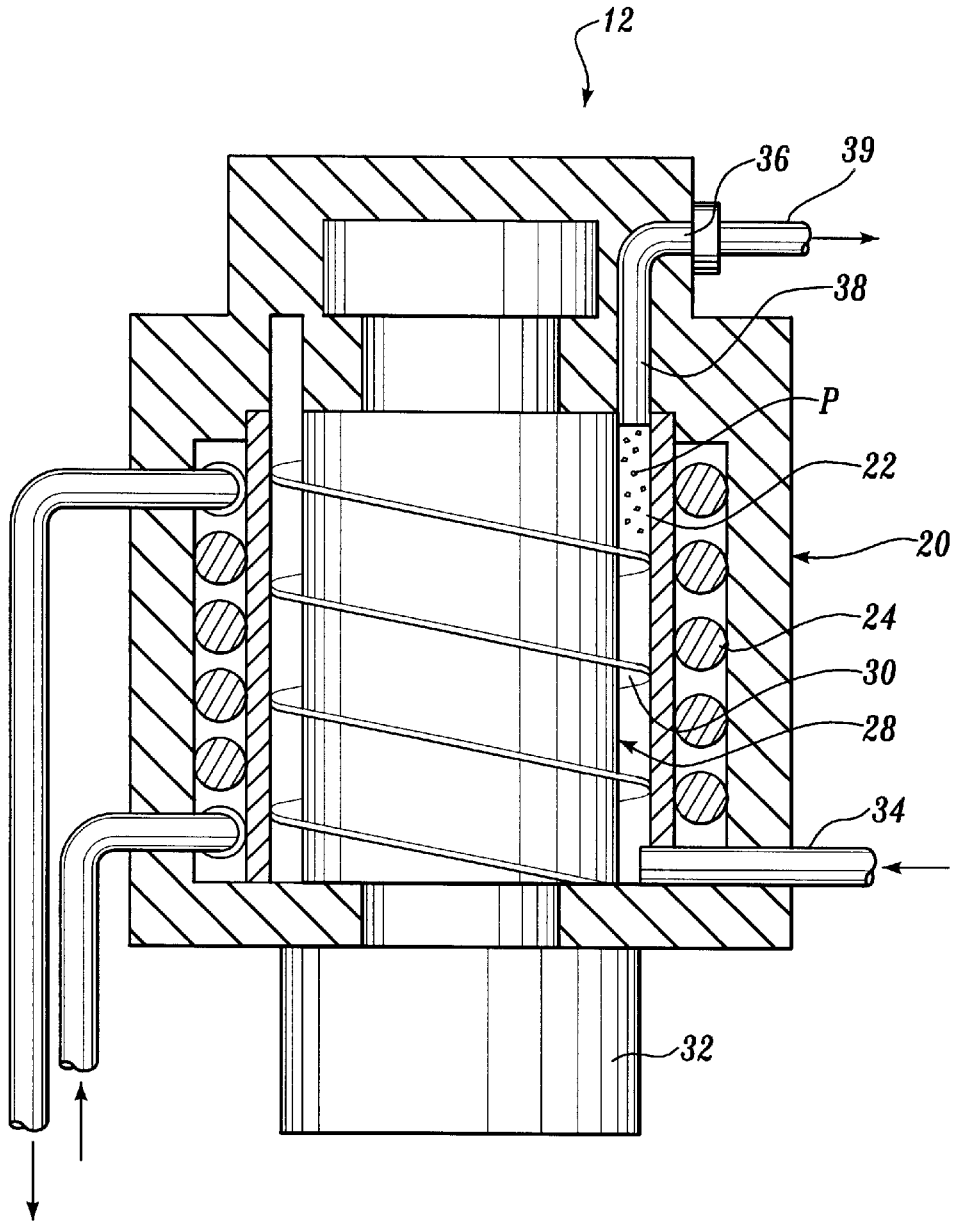
FIG. 2 is a partial cross-sectional side view of an embodiment of an extruder assembly for use with an ice blasting apparatus of the present invention.

FIG. 2 illustrates one preferred embodiment of an extruder assembly 12 for use in the present invention. The assembly includes a sealed housing 20 that defines an upright pressure vessel. A cylindrical freezing chamber 22 is located within the housing 20. A cooling coil 24 or other refrigerant flow path surrounds the freezing chamber 22 and is also located within the housing 20. The cooling coil 24 is provided with refrigerant fluid from a conventional refrigeration unit 26 (shown in phantom in FIG. 1). An elongated cylindrical auger 28 is concentrically located within the freezing chamber 22. The auger 28 includes a spiral cutting thread 30 wound about the auger's curved exterior surface. A drive assembly 32 is connected to the auger 28 to cause suitable rotary motion of the auger during use.

Figure 4:
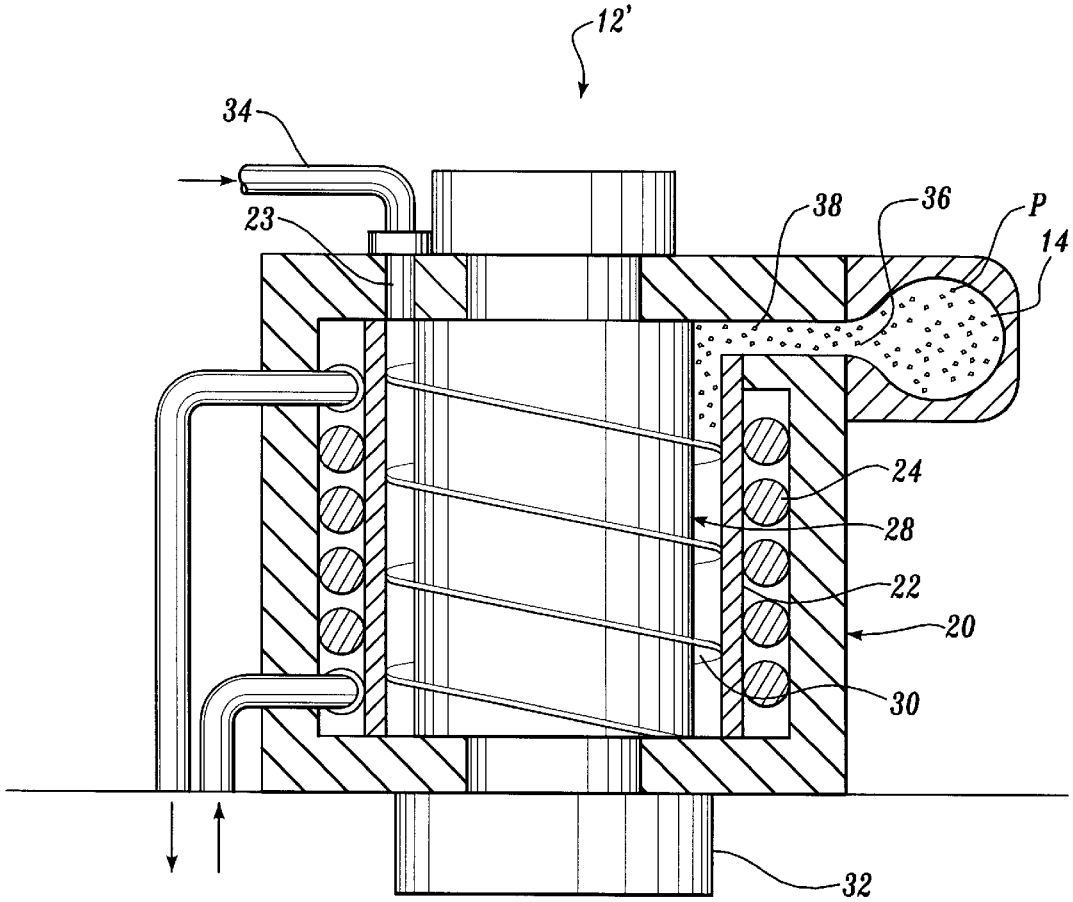
FIG. 4 is a partial cross-sectional side view of an alternative embodiment of an extruder assembly for use with an ice blasting apparatus of the present invention.

The freezing chamber 22 receives pressurized water from a water pump 33 (see FIG. 1) via a water input line 34. In the embodiment illustrated in FIG. 2, the entry of pressurized water into the freezing chamber 22 occurs through a passage in the lower end of the housing 20. In the embodiment of FIG. 4, described below, pressurized water enters the freezing chamber 22 from a passage in the upper end of the housing 20. In both embodiments, the pressurized water moves via gravity to the lowest locations within the freezing chamber 22. During use, ice forms on the chamber interior walls due to the cooling provided by the cooling coils 24 surrounding the freezing chamber 22. The drive assembly 32 causes the auger 28 to rotate about its longitudinal axis. As the auger rotates, its spiral cutting thread 30 scrapes ice particulates P from the chamber walls. As the auger continues to rotate, the released ice particulates P travel upward, partially pushed by the continuous supply of newly scraped ice and partially forced by the rotating auger spiral.

An ice discharge opening 36 is available at the upper end of the housing 20. A passageway 38 extends in the housing between the freezing chamber 22 and the ice discharge opening 36 such that the scraped ice particulates P move quickly and easily from the freezing chamber 22. In one embodiment, the diameter of the passageway 38 is in the range of about 0.5 cm to about 2 cm. The pressure in the receiving line 14, preferably in an amount in the range of about 30 psi to about 120 psi, and suitably up to 250 psi, also pressurizes the interior region of the extruder assembly through the ice discharge opening 36. The rotating auger spiral continuously works to force ice particulates out the discharge opening 36 so long as the opening remains unobstructed.

Once the ice particulates P have been expelled from the discharge opening 36, the ice particulates P enter an intermediate connecting member 39. In the embodiment shown in FIG. 1, the connecting member 39 is between the discharge opening 36 and the ice-receiving line 14. The ice-receiving line 14 includes first and second ends 40, 42. The ice-receiving line first end 40 is supplied with pressurized air, such as would be available from a conventional air compressor 44 or other source of compressed gas. The ice-receiving line second end 42 is connected to the blast nozzle 16. The ice-receiving line 14 is preferably formed of a material having low thermal conductivity, such as plastic or the like. In one embodiment, the ice-receiving line has a diameter in the range of about 1 cm to about 5 cm.

Once the ice particulates P have entered the ice-receiving line 14, the particulates become fluidized with the pressurized air. Together, the particulates and pressurized air move rapidly to the blast nozzle 16. An important feature of the present invention is that the above atmospheric pressure within the extruder assembly 12 is equal to the above atmospheric pressure within the ice-receiving line 14. This causes the ice particulates P to be fluidized under pressure and to be blasted forcefully out the blast nozzle due to the pressure differential between the line pressure and atmospheric discharge. In addition, from the instance of formation in the extruder assembly to the release at the blast nozzle, the ice particulates P are preferably kept in motion so that they do not rest at any point along their travel. This reduces the likelihood that the particulates will become stationary or adhere to a passage surface and form an ice blockage. In further support of an unobstructed flow, the path along which the ice particulates are carried should be smooth and devoid of abrupt changes in cross-sectional area that could lead to the deposition and subsequent accumulation of ice thereon.

The extruder assembly 12 is preferably regulatable such that when the blast nozzle is in an off position, no or only minimal amounts of ice particulates will be extruded from the assembly. This may be accomplished by using a switch or valve with the water supply source so that when the blast nozzle is in an off position, the supply of pressurized water will be automatically cut off to the extruder assembly. For example, a switch on the discharge nozzle may be electrically connected to a valve controlling the water supply, so that the valve opens when the switch is closed for discharge, and the valve closes when the switch is opened upon cessation of discharge.

Figure 3:
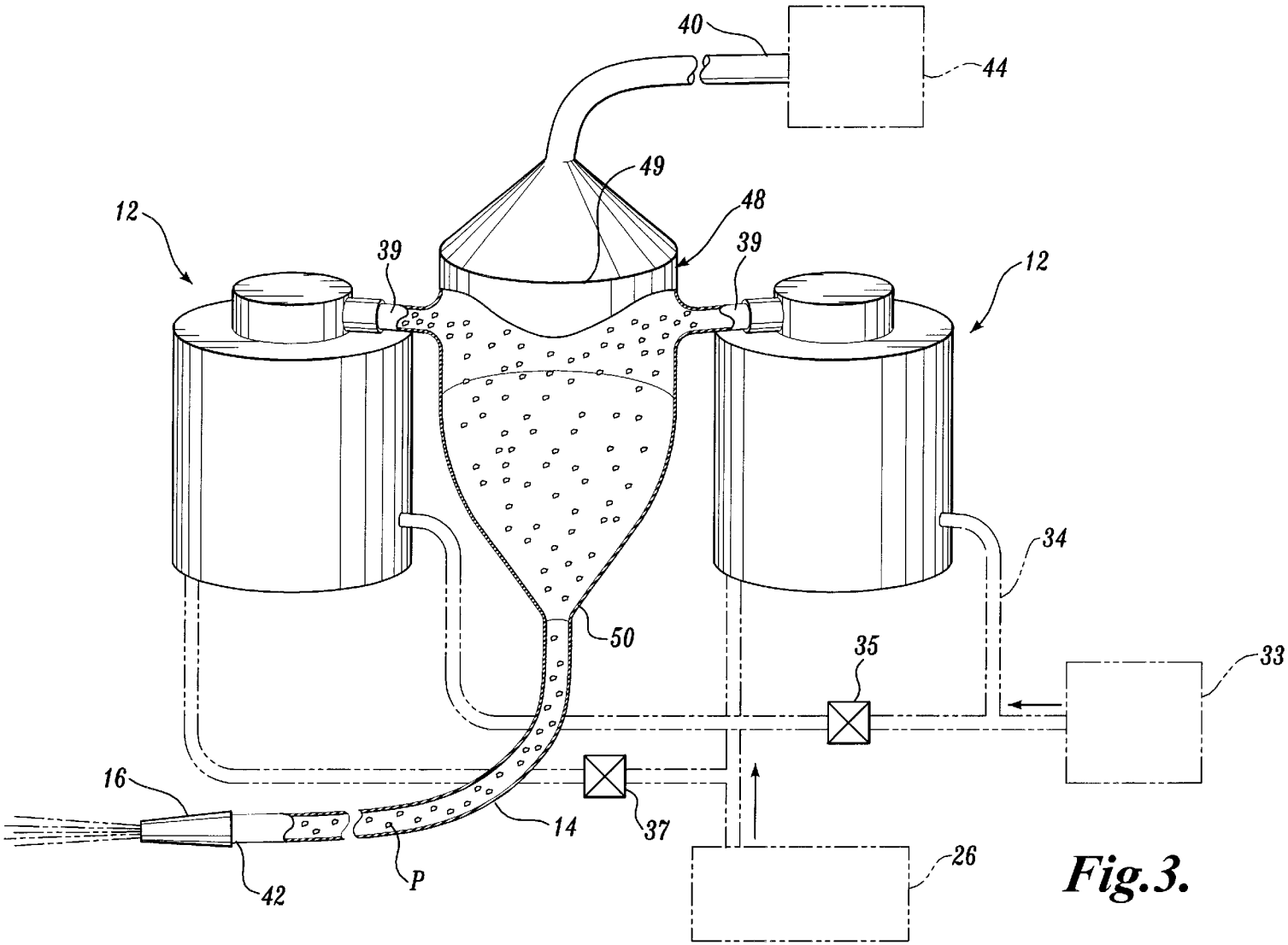
FIG. 3 is a schematic view of an alternative embodiment of an ice blasting apparatus in accordance with the invention showing use of multiple ice extruder assemblies to produce larger quantities of ice particulates.

FIG. 3 is a schematic view of an alternative embodiment of an ice blasting apparatus provided in accordance with the invention showing use of multiple ice extruder assemblies 12 to produce larger quantities of ice particulates. The water pump 33 and the refrigeration unit 26 are connected to the extruder assemblies 12 to provide appropriate amounts of pressurized water and refrigerant. Additional control valves 35, 37 may be added to the water input line 34 and the refrigerant input line for applications in which ice particulate needs varying between the amounts supplied by a single extruder assembly versus amounts supplied by multiple extruder assemblies. This arrangement allows an operator to easily modify their ice blast operation to accommodate blasting projects of all sizes.

In the embodiment of FIG. 3, the ice particulate output of both extruder assemblies is directed into a common manifold 48. The manifold 48 is generally cylindrically-shaped with the ice-receiving line 14 being connected to a first end 49 of the manifold 48 and continued on from a second, opposite, end 50 of the manifold 48.

Short connecting members 39 extend between each extruder assembly 12 and the common manifold 48. The interior connecting surfaces of the ice-receiving line 14, the manifold 48, and the short connecting members 38 are smooth, with substantially constant cross-sectional shapes where possible. This helps to eliminate rough interior flow surfaces that might trip moving ice particulates or otherwise cause ice accumulations to form. Within these constraints, the manifold 48, ice-receiving line 14, and short connecting members 38 may have any one of many possible designs that may readily occur to one of ordinary skill in the art who has read this disclosure.

Referring back to FIG. 1, it is possible to optionally include additives into the ice-receiving line as needed for certain applications where direct addition to the water supply is not desirable. Additives such as neutralizing agents, corrosion inhibitors, deodorizing chemicals, etc., can be introduced from a reservoir 51 via a pressure pump into the pressurized ice-receiving line at a location that contains the ice particulates to be discharged from the blast nozzle 16.

Figure 5:
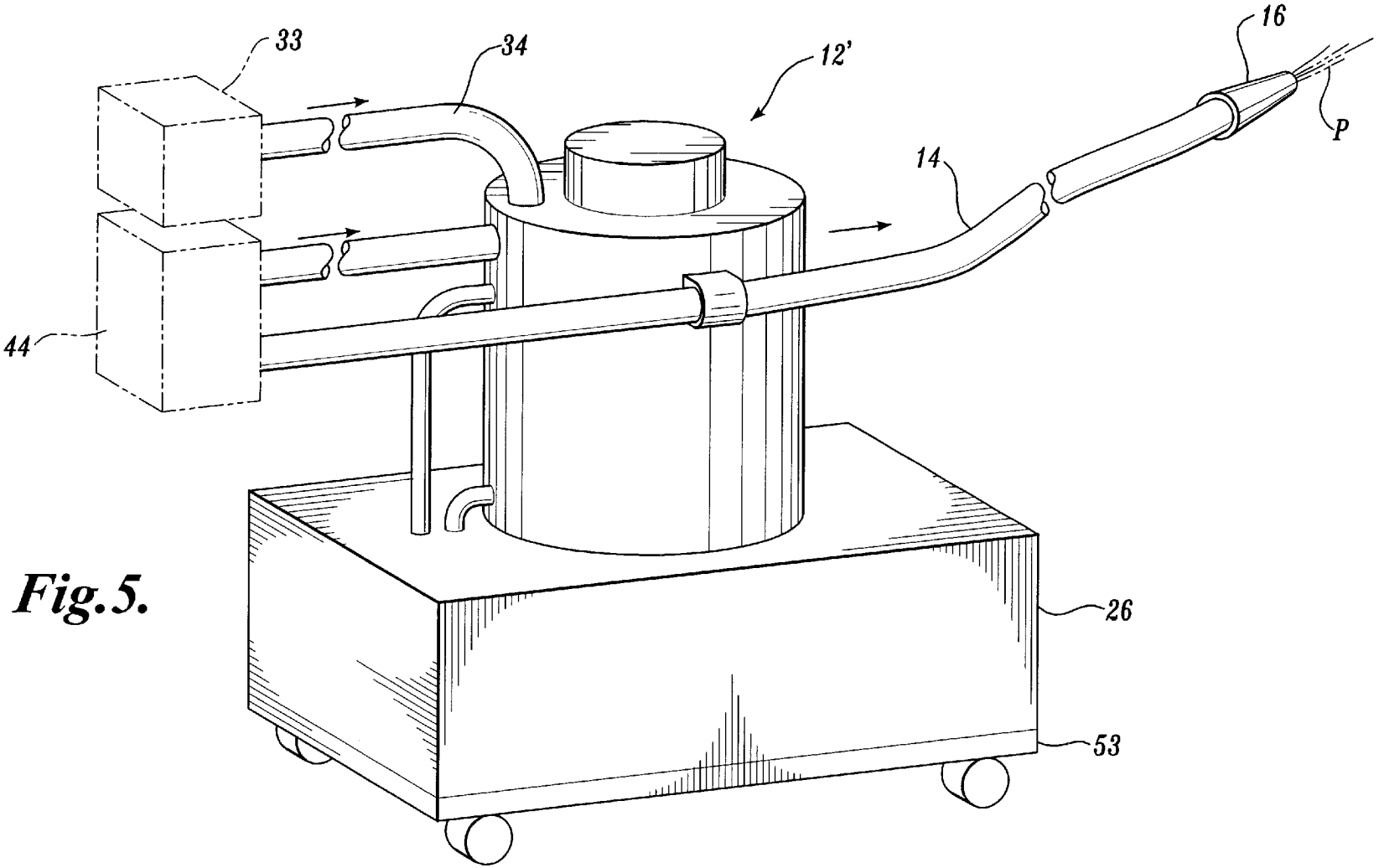
FIG. 5 is a schematic view of a mobile embodiment of an ice blasting apparatus formed in accordance with the present invention.
Figure 6:
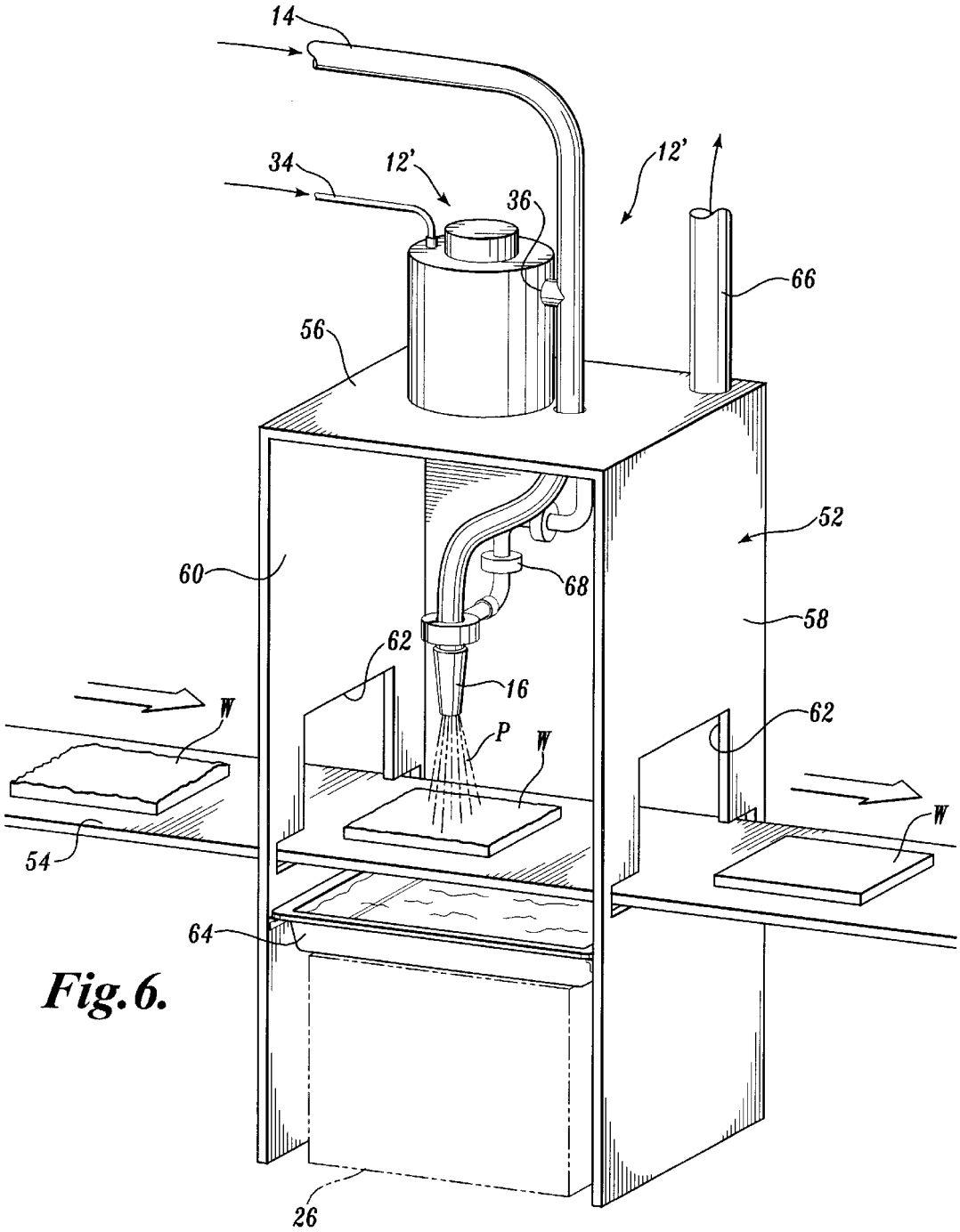
FIG. 6 is a perspective view of a stationary embodiment of an ice blasting apparatus formed in accordance with the present invention.
Figure 7:
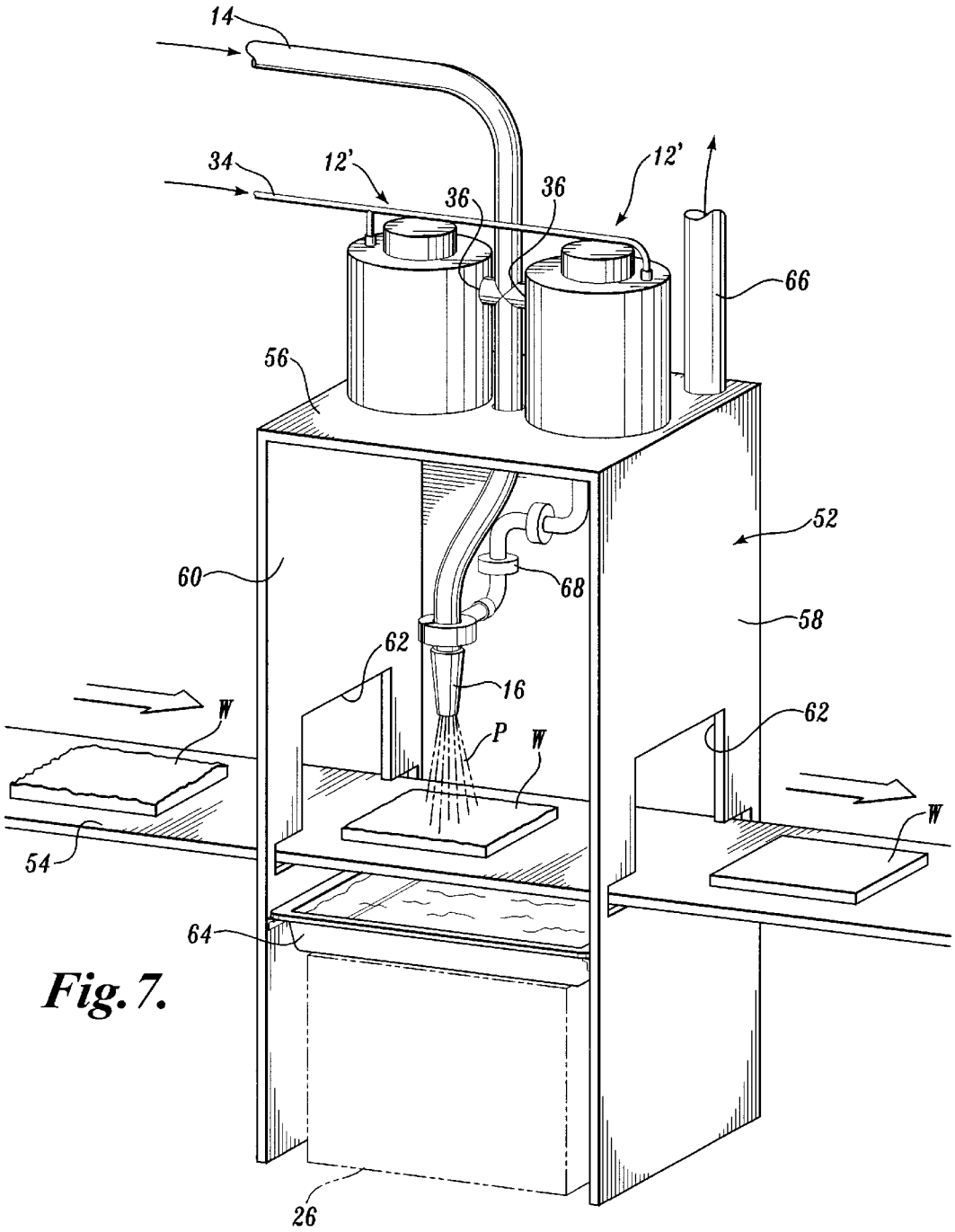
FIG. 7 is a perspective view of an alternative arrangement of a stationary ice blasting apparatus in accordance with the invention showing use of multiple ice extruder assemblies to produce larger quantities of ice particulates.

FIGS. 5–7 illustrate additional alternative embodiments of the present invention. Like components are numbered using similar numbering as provided in FIGS. 1–4. FIG. 5 is a portable ice blasting apparatus having a movable platform 53 upon which a refrigeration unit 26 is supported. The extruder assembly 12' is positioned on top of the refrigeration unit 26. As will be appreciated by those of ordinary skill in the art, in such arrangements it may be advantageous to form the support platform 53, refrigeration unit 26, and extruder assembly 12' as a single unit. Such arrangements are within the scope of the present invention.

The portable ice blasting apparatus preferably uses the alternative extruder assembly 12' shown in FIG. 4. The alternative extruder assembly 12' is similar to that shown in FIG. 2, except the water input line 34 provides pressurized water to the freezing container 22 through an upper opening 23 in the housing. Further, the ice-receiving line 14 is modified to connect more directly to the ice discharge opening 36. See also FIG. 5. This reduces the possibility of lines becoming tangled during use. As with the arrangements of FIGS. 1 and 3, the portable ice blasting apparatus of FIG. 5 also relies on pressurization of the extruder assembly 12' to continuously deliver ice particulates P into the pressurized ice-receiving line 14. The pressure of the water supply must be set higher than that in the extruder assembly 12'.

FIGS. 6 and 7 are ice blasting arrangements for use in a production-line environment. FIG. 6 illustrates an ice blasting apparatus having a single extruder assembly 12'. FIG. 7 illustrates an ice blasting apparatus using multiple extruder assemblies 12'. Both arrangements include an upright support frame 52 capable of being located at a conveyor belt 54. The frame 52 includes an upper shelf 56 upon which at least one extruder assembly 12 is located. In general, it is preferable that the frame 52 further include upright walls 58, 60 to contain the blast noise and the blast debris, as is required in many manufacturing environments. The side walls shown are fitted with appropriate windows 62 to accommodate passage of work objects W being transferred by the moving conveyor 54. The frame 52 optionally includes a drain pan 64 positioned beneath the conveyor 54 to collect melted ice water and blast debris. An exhaust vent 66 preferably removes blast air and blast noise away from the conveyor to an outside environment. As shown, the refrigeration unit 26 may be conveniently placed beneath the conveyor 54 within a lower region of the upright support frame 52.

As above, each extruder assembly 12' includes a pressure vessel within which ice particulates P are continuously formed under elevated pressure. In the embodiments of FIGS. 6 and 7, the blast nozzle 16 extends downward from the underside of the upper shelf 56 and is positioned directly above the conveyor belt 54. As shown, the blast nozzle 16 may be made movable by conventional robotics 68. The ice-receiving line 14 receives a fluidizing gas medium from the pressurized air supply source 44 (not shown in FIGS. 6 or 7) and ice particulates P from the ice discharge opening 36 of the extruder assembly 12'. The pressure gradient within the ice-receiving line 14 during use quickly forces the ice particulates P from the extruder assembly 12' to the blast nozzle to be expelled. As work objects W on the conveyor belt 54 pass beneath the blast nozzle 16, the ice particulates P impinge upon each of the objects to do useful work.

As will be appreciated from a reading of the above, the present invention provides a method and apparatus for forming ice particulates under pressure for transport to a blast nozzle via pressure flow for eventual ejection from the blast nozzle to perform blast cleaning work. The present invention can be easily arranged to provide a varying amount of ice particulate production to meet varying ice particulate requirements. Although only a few exemplary embodiments of this invention have been described in detail above, those of ordinary skill in the art will readily appreciate that many modifications are possible in the exemplary embodiments without materially departing from the novel teachings and advantages of this invention. Accordingly, all such modifications are intended to be included within the scope of this invention as defined in the following claims.

The embodiments of the invention in which an exclusive property or privilege is claimed are defined as follows:

1. A method of producing a stream of ice particulates for use in ice blasting a work surface, the method comprising:

(a) continuously producing ice particulates in at least one extruder assembly, the extruder assembly including a pressure vessel within which the ice particulates are formed under an elevated pressure;

(b) passing the ice particulates under pressure from the pressure vessel to an ice-receiving line containing a fluidizing gas medium at substantially the same elevated pressure to produce a fluidized stream; and (c) discharging the fluidized stream of ice particulates and the fluidizing gas medium from the ice-receiving line through a blast nozzle toward the work surface.

2. The method according to claim 1, wherein the pressure in the pressure vessel and the ice-receiving line is in the range of about 20 psi to about 120 psi.

3. The method according to claim 1, wherein the pressure vessel maintains the elevated pressure by receiving pressurized fluidizing gas medium from the ice receiving line.

4. The method according to claim 1, wherein the step of substantially continuously passing pressurized ice particulates from the pressure vessel to the pressurized ice-receiving line includes passing the pressurized ice particulates through an intermediate connecting member that is attached between the extruder assembly and the ice-receiving line.

5. The method according to claim 1, further comprising adding an additive to the fluidized pressurized ice particulates within the pressurized ice-receiving line prior to release at the blast nozzle.

6. The method according to claim 1, wherein the extruder assembly includes a water supply that supplies water to an auger assembly, the auger assembly including a cylindrical freezing chamber, a refrigerant flow path surrounding the freezing chamber, and an auger having a spiral cutting thread rotatably mounted within the freezing chamber, the cutting thread scraping ice formed on an interior wall of the chamber to produce the ice particulates.

7. The method according to claim 6, wherein the pressure vessel receives water at a higher pressure from an input opening located in a lower region of the freezing chamber.

8. The method according to claim 6, wherein the pressure vessel receives water at a higher pressure from an input opening located in an upper region of the freezing chamber.

9. The method according to claim 1, wherein the at least one extruder assembly comprises at least two extruder assemblies.

10. The method according to claim 9, wherein prior to passing the pressurized ice particulates from the pressure vessels of the at least two extruder assemblies into the ice-receiving line, the ice particulates are passed into a common manifold interconnected between the at least two extruder assemblies and the ice-receiving line.

11. An apparatus for supplying and accelerating ice particulates in applications having access to a pressurized gas supply source that provides a pressurized fluidizing gas medium and having access to a pressurized water supply source that provides water, the apparatus comprising:

(a) an extruder assembly including a pressure vessel within which the ice particulates are substantially continuously formed under elevated pressure, the extruder assembly including a water input port adapted to receive water from the water supply source and an ice discharge opening;

(b) a blast nozzle;

(c) an ice-receiving line having a port adapted to be placed in fluid communication with the pressurized gas supply source, and having a first end connected to the ice discharge opening of the extruder assembly, and a second end connected to the blast nozzle, the pressure within the ice-receiving line and within the extruder assembly being maintained at substantially the same elevated pressure by introduction of the pressurized gas to the ice-receiving line, ice particulates from the extruder assembly being received and fluidized within the ice-receiving line for discharge through the blast nozzle.

12. The apparatus according to claim 11, wherein the extruder assembly pressure vessel is designed to operate at pressures up to about 250 psi.

13. The apparatus according to claim 11, wherein the connection between the first end of the ice-receiving line and the discharge opening of the extruder assembly includes an intermediate connecting member.

14. The apparatus according to claim 11, wherein the extruder assembly includes an auger assembly having a cylindrical freezing chamber; a refrigerant path surrounding the freezing chamber, and an auger rotatably mounted within the freezing chamber and having a spiral cutting thread; the discharge opening being located in an upper region of the auger assembly.

15. The apparatus according to claim 14, wherein the freezing chamber includes a discharge opening, the extruder pressure vessel thereby maintaining an elevated pressure by being in fluid communication with pressurized fluidizing gas medium.

16. The apparatus according to claim 11, wherein the ice-receiving line and the intermediate connecting member are both formed of a thermally insulating material.

17. The apparatus according to claim 11, wherein the ice-receiving and the intermediate connecting member each have a diameter in the range of about 0.5 cm to about 5 cm.

18. The apparatus according to claim 11, further comprising an additive input line connected to the ice-receiving line and capable of inputting an additive to the fluidized pressurized ice particulates prior to release at the blast nozzle.

19. The apparatus according to claim 11, wherein the at least one extruder assembly comprises at least two extruder assemblies.

20. The apparatus according to claim 19, further comprising a common manifold interconnected between the at least two extruder assemblies and the ice-receiving line, ice-particulates discharged by the at least two extruder assemblies being directed into the common manifold prior to entering the ice-receiving line.

21. The apparatus according to claim 20, wherein the manifold is cylindrically shaped and includes smoothly shaped interior surfaces.

* * * * *